US006152242A

United States Patent [19]

Chung

[11] Patent Number: 6,152,242

[45] Date of Patent: Nov. 28, 2000

[54] SCREW BUTTON SWITCH DEVICE

[76] Inventor: Lee Hsin-Chih Chung, No. 21-8, Shang San Cho Woo, Wuchang-Li, Chungli City, Tao Yuan Hsien, Taiwan

[21] Appl. No.: 09/377,318

[22] Filed: Aug. 19, 1999

[51] Int. Cl.[7] ..... B25D 11/04

[52] U.S. Cl. ..... 173/48; 173/216

[58] Field of Search ..... 173/48, 217, 178, 173/114, 109, 216, 176, 205; 408/20

[56] References Cited

U.S. PATENT DOCUMENTS

| | | | |
|---|---|---|---|
| 5,375,665 | 12/1994 | Fanchang et al. | 173/48 |
| 5,449,043 | 9/1995 | Bourner et al. | 173/216 |
| 5,451,127 | 9/1995 | Chung | 408/20 |
| 5,531,278 | 7/1996 | Lin | 173/178 |
| 5,704,433 | 1/1998 | Bourner et al. | 173/48 |
| 5,711,380 | 1/1998 | Chen | 173/109 |
| 6,070,675 | 6/2000 | Mayer et al. | 173/48 |

*Primary Examiner*—Scott A. Smith

*Attorney, Agent, or Firm*—Ostrolenk, Faber, Gerb & Soffen, LLP

[57] ABSTRACT

A switch device for a screw button is disclosed. The switch device includes a slowdown box with a switch base, which consists of two sets of concave gears with appropriate spacing located on the axial plane around the outer brim, each set having a plurality of switch concave gears. The side on which the switch gears located is formed as a inclined surface, which is used to coordinate with a plurality of switch concave gears corresponding to the switch convex gears where the respective axial surface of the switch base in the switch block are set. The switch block thereby controls the switch convex gears to engage or disconnect with the switch concave gears when rotating. The motion of the output axis in radial direction is manipulated to determine whether the vibrating block fixed on the output axis can vibrate when the output axis is pressed and rotates to induce vibration because engaged with the vibrating base. Therefore, the rotating ring, inner ring gear, sun gear, and rotating ring of the slowdown box in the prior arts are eliminated to simplify the whole structure.

1 Claim, 5 Drawing Sheets

SCREW BUTTON SWITCH DEVICE

FIELD OF THE INVENTION

The present invention relates to a screw button switch device. Furthermore, the switch device adjusts the output axis of an electric tool to switch between pure rotation and vibration by the screw button rotating 360°; also, simplifiers the structure and achieves the manufacturing cost reducing.

BACKGROUND OF THE INVENTION

The traditional electric tool can only be used to rotate the screw driver or drill, but it is sometimes difficult to drill a hole or drive out the screw due to material characteristic or the screw too tight. Some improved electric tools have been developed, which consist of an output axis that can be switched to pure rotation mode or rotation with axial vibration so that the drill can be easily drilled into the target body or the tight screw be screwed out of the target body. Taiwan Patent NO. 87210470 is disclosed to provide a screw button switch device with rotation and vibration characteristic to facilitate the operation of the electric tool. However, the above device has to rotate the screw button about 360° to switch the operation mode of the output axis between pure rotation and rotation with axial vibration. Additionally, numbers of components are too much and the whole structure is more complicated as a result of higher cost of manufacturing. Therefore, the present invention is provided to overcome the above shortcomings.

SUMMARY OF THE INVENTION

An object of the present invention is to provide a screw button switch device, used to rotate the screw button with 360° so as to adjust the output axis to operate in pure rotation or rotation with axial vibration.

In the present invention, the components such as a direction change ring, inner gear ring, sun gear, and rotate ring forming the slowdown device are eliminated and the switch device can still achieve the switch function when the screw button rotates with 315°.

The screw button switch device provided by the present invention is primarily characterized as a specific switch base in the slowdown box cover. Two sets of concave gears located around a circle with appropriate spacing are on the axial face of the switch base. The side of the switch gears forms a inclined surface. The corresponding axial surface of the switch block in the switch base has a plurality of switch convex gears with respect to the concave gears. The switch block is driven to rotate to control and switch the switch convex gears to engage or disconnect with the switch concave gears by even force. The axial motion of the output axis is thereby controlled to determine whether the vibrating block on the output axis can engage with the vibration base to result in vibration when the output axis presses the vibration block and operates. Therefore, the slowdown device formed by the direction change ring, inner gear ring, sun gear, and rotate ring in the above-disclosed patent can be eliminated to simplify the whole structure.

Other features and advantages of the invention will become apparent from the following description of the invention that refers to the accompanying drawings.

DETAILED DESCRIPTION OF THE PREFERRED EMBODIMENTS

Figure 1:
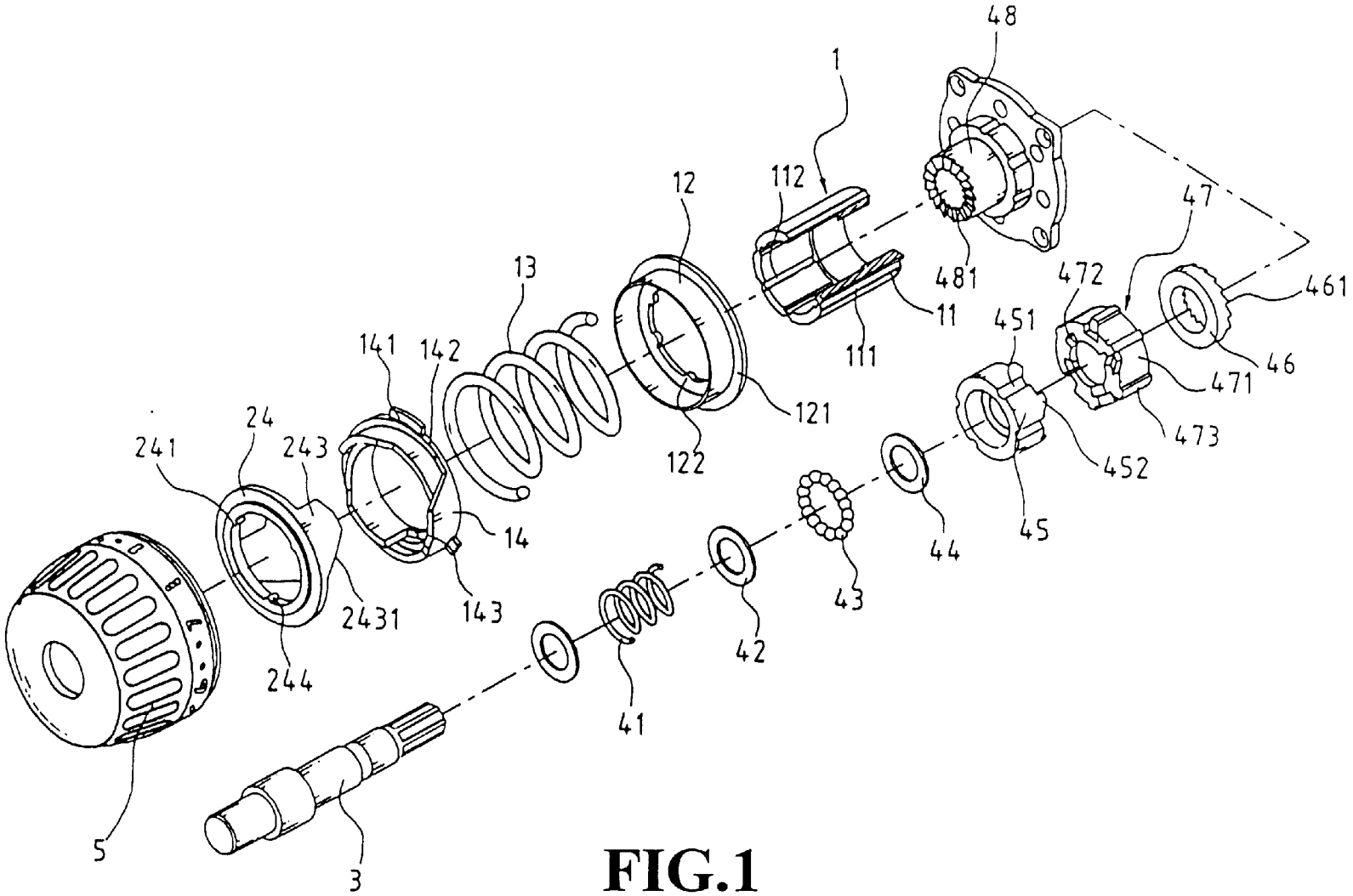
FIG. 1 is a three-dimensional explosion diagram of the components in accordance with the present invention.
Figure 2:
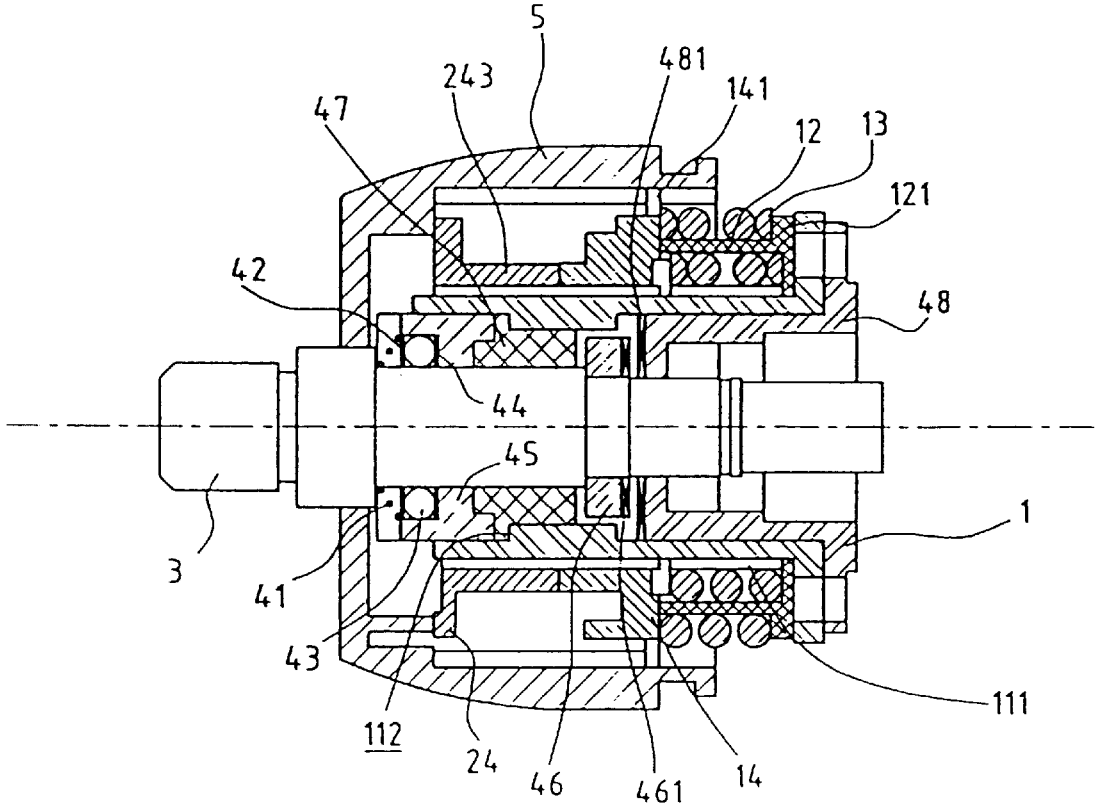
FIG. 2 is a cross-sectional schematic diagram illustrating the assembled structure of the components shown in FIG. 1.
Figure 3:
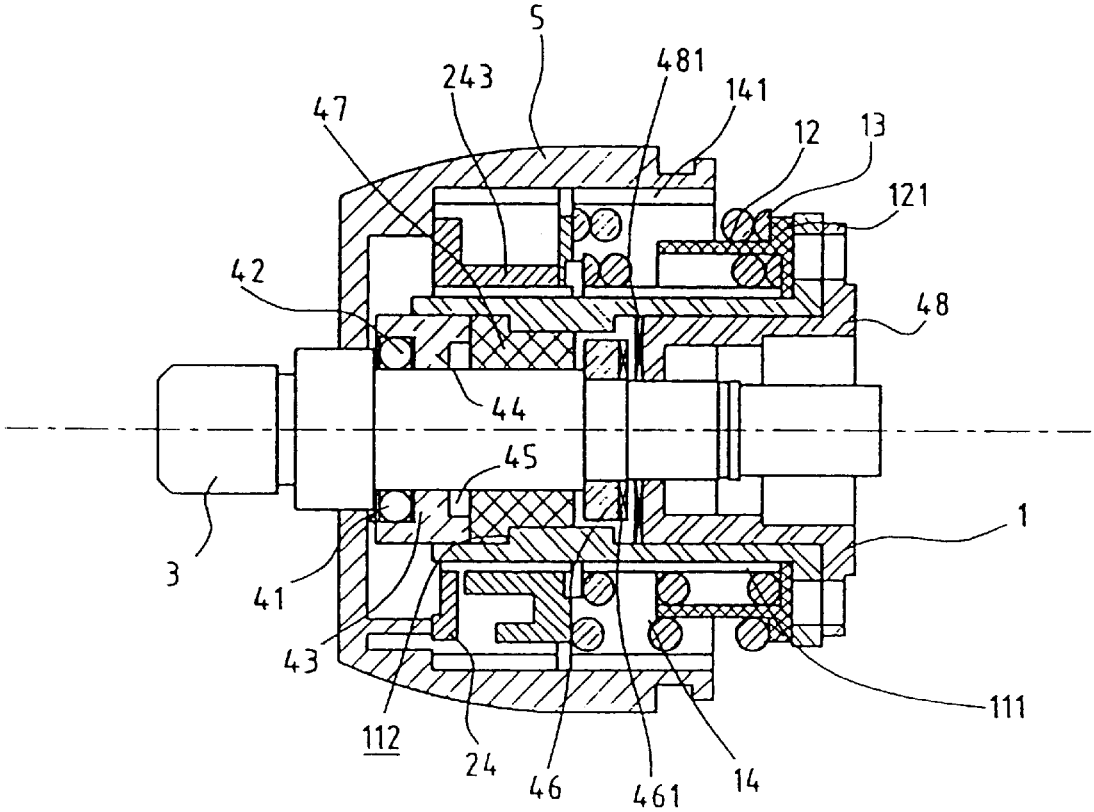
FIG. 3 is a cross-sectional view of the structure of FIG. 2 in operation.
Figure 4:
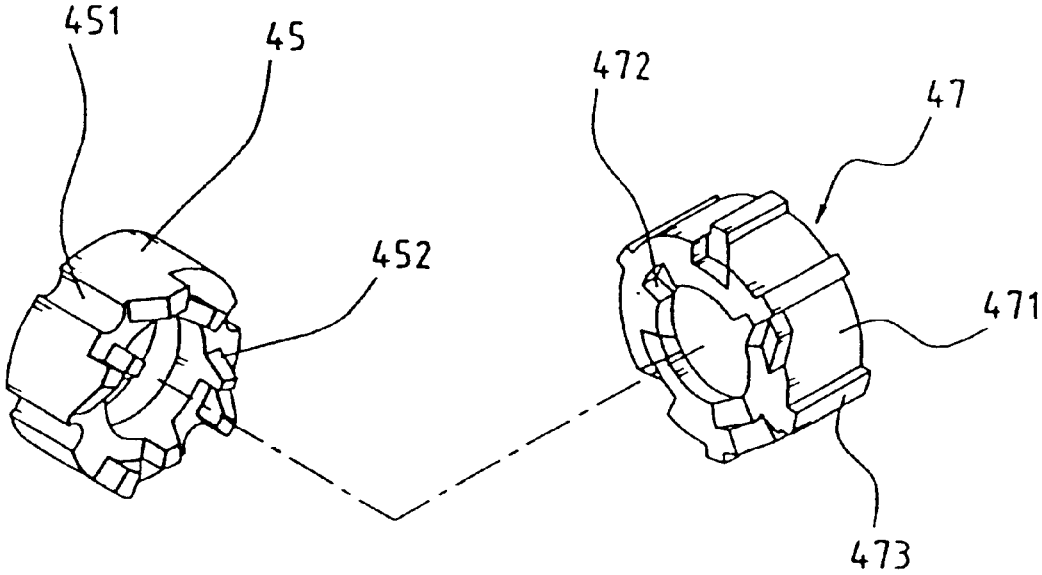
FIG. 4 shows a three-dimensional schematic diagram of the switch base and switch block in accordance with the resent invention.
Figure 5:
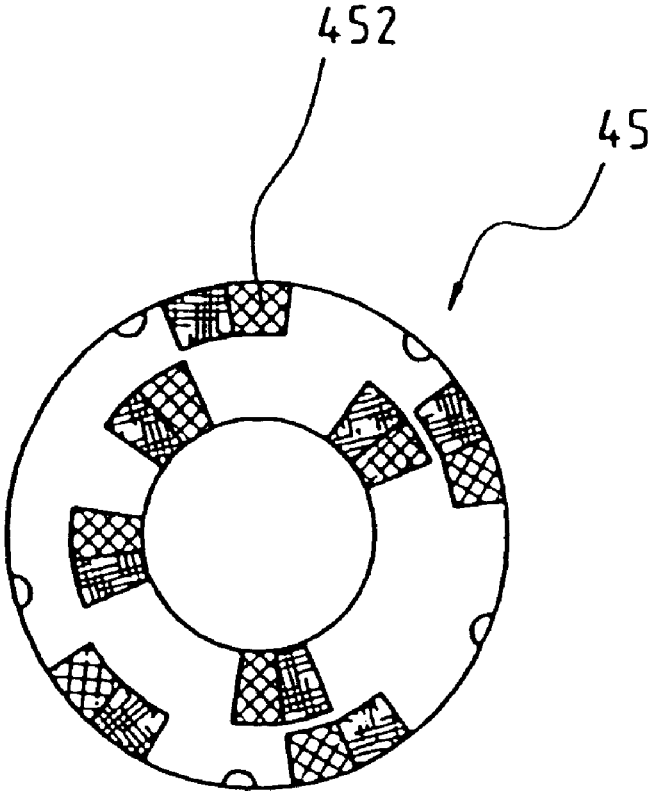
FIG. 5 shows a side view of the configuration of the switch gear in the switch block in accordance with the present invention.

With reference to FIGS. 1 and 2, The screw button switch device provided by the present invention includes a slowdown box cover 1 with a hollow cylinder body 11 and a vibrating base 48 at the front and back ends, respectively. The front part of the inner radius in the cylinder body 11 forms an inner brim 112, which has a plurality of axial inner slots 113 in parallel around the periphery. The outer side of the cylinder body 11 has a plurality of axial outer slots 111 in parallel. The vibrating base 48 comprises a cylinder part fitting to the inner radius of the slowdown box cover 1 to tightly press and fix. The front part of the vibrating base 48 further includes gear part 481 as a body. The cylinder body 11 of the slowdown box cover 1 on the outer side includes a steel ball press ring 12, a spring 13, and a stop ring 14 in sequence. The steel ball press ring 12 at the back end has a convex brim 121 around the periphery. A plurality of projection parts 122 corresponding to the above outer slots 111 are on around the inner periphery of the convex brim 121. Thereby, the projection part 122 slides along the outer slots 111*a* and the steel ball press ring 12 inserts into the cylinder body 11 to make the steel ball press ring 12 fixed and not rotate around the cylinder body 11. The spring 13 inserts into the cylinder body 11 and presses the convex brim 121 of the steel ball press ring 12. The stop ring 14 has a plurality of projection fins 141. Three screw tracks with different outer radiuses and continuous heights are at the front end. The screw track forms a lower screw track 142 and a upper screw track 143. The inner radius of the stop ring 14 just fits to the outer radius of the cylinder body 11, and inserts into the cylinder body 11 to press the other end of the spring 13. Furthermore, the stop ring 14 can rotate around the cylinder body 11. The inner radius of the slowdown box cover 1 has an output axis 3, which from the front to the back penetrates a spring 41, a pad 42, a steel ball 43, a pad 44, a switch block 45, a switch base 47, and a vibrating block 46. The vibrating block 46 is fixed on the output axis 3 and the back end of the vibrating block 46 forms a gear part 461 which can engage with a gear part 481 of the vibrating base 48. Additionally, the vibrating block 46 can insert into a penetrating hole of the slowdown box cover 1. The base body 471 of the switch base 47 includes a plurality of projection blocks 473 around the outer side and two sets of switch convex gears 472 at the front end. Each set of switch convex gears 472 are arranged as a circle such that the projection block 473 of the switch base 47 can slide along the inner slot 112 and insert into the penetrating hole of the slowdown box cover 1 to prevent the switch base 47 from rotating in the slowdown box cover 1 and further become fixed. The switch block 45 is used to coordinate with the penetrating hole of the slowdown box cover 1. The back end of the switch block 45 has two sets of switch convex gears 452 corresponding to the above switch convex gears 472 and around the periphery. The side on which the switch convex gears 452 are located forms an inclined surface (as shown in FIG. 5). A plurality of notches 451 are around the periphery of the switch block 45. The two pads 42 and 44 are located on the two sides of the steel ball 43, respectively, and placed within the switch block 45. The spring 41 presses the convex brim of the pad 42 and the output axis 3. The switch convex gears 452 of the switch block 45 are always kept in contact with the axial surface of the switch base 47 due to the elastic force of the spring 41.

The front end of the slowdown box cover 1 of the present invention includes a switch device 2, which consists of a stop ring 14, a upper stop plate 24, and a screw button 5. Before forming a ring frame, the stop ring 14 includes three screw tracks with different outer radiuses and continuous heights at the front end. Each screw track has a upper screw track 143 and a lower screw track 142. The stop ring 14 can fit to the outer radius of the cylinder body 11 of the slowdown box cover 1 and rotate around the cylinder body 11. The upper stop plate 24 has a convex ring 241 at the front end of the ring frame. The inner radius of the ring frame just corresponds to and insert into the outer radius of the cylinder body 11 of the slowdown box cover 1. The convex ring 241 has a concave part 242. The back end of the ring frame includes three convex parts 243 of the three screw tracks coordinated with the above stop ring 14. Additionally, the inner radius of the upper stop plate 24 consists of a plurality of guide blocks 244 corresponding to the outer slot 111 of the slowdown box cover 1 such that the upper stop plate 24 can not rotate around the cylinder body 11 through the guide blocks 244 coordinated with the outer slot 111 of the slowdown box cover 1 after inserting into the cylinder body 11. The stop ring 14 and the upper stop plate 24 are covered with the screw button 5, used to locate the stop ring 14 on the inner brim of the screw button 5 and control the stop ring 14 to rotate. The convex part 243 of the upper stop plate 24 moves along the screw track of the stop ring 14 from the lower screw track 142 to the upper screw track 143, or from the upper screw track 143 to the lower screw track 142 so as to push the spring 13 to obtain the rotation twist force used to adjust the output axis 3 when the screw button 5 clockwise rotates to rotate the stop ring 14. Meanwhile, the switch convex gear 452 of the switch block 45 can be switched to locate on the switch convex gear 472 of the switch base 47 to stretch the spring 41 such that the convex brim of the output axis 3 and the inner radius of the switch block 45 has sufficient space (as shown in FIG. 2). Therefore, the operator may make the output axis 3 press the screw or other parts in the axial direction resulting in that the vibrating block 46 may make the gear part 461 engage with the gear part 481 of the vibrating base 48 according to the radial motion of the output axis 3 and the output axis 3 may vibrate when rotating. The output twist force can be adjusted when the force on the back end forward asserted by the output axis 3 reduces (The detail operation is not described here because not related to the present invention).

The screw button 5 rotates counterclockwise if the output axis 3 is required to purely rotate without axial vibration. The screw button 5 also drives the stop ring 14 to rotate, thereby the screw track of the stop ring 14 presses and pushes the convex part 243 of the upper stop plate 24 to make the upper stop plate 24 move forward in the axial direction of the front end until the convex part 243 moves to the lower screw track 142. The switch block 45 is also driven to rotate by pushing the inclined surface of the switch convex gear 452 off the switch convex gear 472 of the switch base 47 when the switch block 45 presses the spring 41 such that the convex brim of the output axis 3 and the inner radius of the switch block 45 has sufficient space has no sufficient space. Therefore, when the operator make the output axis 3 press the screw or other parts in the axial direction, the output axis 3 can not drove the vibrating block 46 to move in the axial direction so as not to engage with the gear part 481 of the vibrating base 48 resulting in that the output axis 3 purely rotates without axial vibration. Two sets of a plurality of switch convex gears 452 and switch convex gears 472 are located around periphery on the switch block 45 and the switch base 47, respectively. The switch convex gears 452 and switch convex gears 472 are asserted with even force when disconnecting with each other and the axial surfaces are still in contact. The effect of stabilizing the rotation motion is achieved so as to eliminate the slowdown box device included in the above-mentioned Taiwan patent. Further, the whole structure is simplified and manufacturing cost is reduced.

Although only the preferred embodiments of this invention were shown and described in the above description, it is requested that any modification or combination that comes within the spirit of this invention be protected.

What is claimed is:

1. A screw button switch device, comprising:

a slowdown box with a cylinder body, the cylinder body having a plurality of concave gears located around an outer brim of a cylinder bottom;

a steel ball press ring, coordinated with an outer radius of the cylinder body of the slowdown box cover;

a spring, coordinated with an outer radius of the cylinder body of the slowdown box cover and pressing said steel ball press ring;

a stop ring, fitting to said outer radius of the cylinder body of the slowdown box cover, freely rotating, and pressing another end of said spring;

a switch base, coordinated with said inner cylindrical radius of said slowdown box;

a switch block, coordinated with said inner cylindrical radius of said slowdown box;

an output axis, sequentially penetrating a spring, said switch base, vibrating block, and vibrating base which are assembled in said inner radius of the cylinder body of the slowdown box cover; and a switch device, which comprises a stop ring, a upper stop plate, and a screw button, said stop ring having a plurality of screw tracks, each screw track located around a circle with different radius and having different height, said stop ring fitting said outer radius of the cylinder body of the slowdown box cover and freely rotating, said upper stop plate forming a ring frame, said ring frame corresponding to and fitting to said outer radius of the cylinder body of the slowdown box cover, said ring frame having a concave part in a front end and having a plurality of convex parts coordinated with said screw track of the stop ring in a back end, said screw button covering and fixed to an outer part of the stop ring, wherein said screw button switch device is characterized as:

said switch base comprises two sets of switch concave gears with appropriate spacing located on an axial plane around the outer brim, a side on which said switch concave gears is located forming an inclined surface, an axial plane of said switch block having two sets of switch convex gears which correspond to said switch convex gears, said switch base and switch block thereby rotating with respect to each other to control the switch convex gears to engage or disconnect with the switch concave gears, and further controlling whether said switch base is moved in radial direction.

* * * * *